United States Patent [19]

Struntz

[11] Patent Number: 4,566,207

[45] Date of Patent: Jan. 28, 1986

[54] SPORTS SHOE

[76] Inventor: Bernard J. Struntz, 1002 Woodbridge St., St. Paul, Minn. 55117

[21] Appl. No.: 520,415

[22] Filed: Aug. 4, 1983

[51] Int. Cl.[4] ..... A43B 11/00; A43C 5/00; A43C 9/00

[52] U.S. Cl. ..... 36/50; 2/DIG. 6; 24/140

[58] Field of Search ..... 36/50; 2/DIG. 6; 24/140, 143 R

[56] References Cited

U.S. PATENT DOCUMENTS

| | | | |
|---|---|---|---|
| 163,804 | 5/1875 | Plant | 24/140 |
| 3,137,952 | 6/1964 | Shears | 36/50 |
| 4,275,513 | 6/1981 | Antonius | 36/50 |
| 4,282,657 | 8/1981 | Antonius | 36/50 |
| 4,282,659 | 8/1981 | Bourque et al. | 36/50 |
| 4,296,558 | 10/1981 | Antonius | 36/50 |
| 4,308,672 | 1/1982 | Antonius | 36/50 |

FOREIGN PATENT DOCUMENTS

| | | | |
|---|---|---|---|
| 62954 | 6/1914 | Austria | 24/140 |
| 1475957 | 2/1967 | France | 36/50 |
| 2375841 | 9/1978 | France | 36/50 |
| 172058 | 5/1933 | Switzerland | 36/50 |
| 100983 | 8/1916 | United Kingdom | 36/50 |
| 1043723 | 9/1966 | United Kingdom | 36/50 |

OTHER PUBLICATIONS

Journal of AMA, vol. 168, No. 7, 10/1958, Maurice Gershman, M.D.

*Primary Examiner*—Werner H. Schroeder
*Assistant Examiner*—Steven N. Meyers
*Attorney, Agent, or Firm*—James V. Harmon

[57] ABSTRACT

A sports shoe is described in which the conventional laces are replaced by one or more straps having sticky cloth surfaces including two component fabrics of different composition adapted to stick together in the nature of the material sold under the trademark VELCRO. The strap is passed through an eyelet connected to one side of the shoe, folded back upon itself, pulled tight, and held together by means of the sticky cloth surfaces.

2 Claims, 6 Drawing Figures

FIG. 1
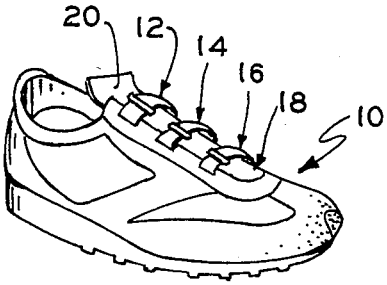
FIG. 2
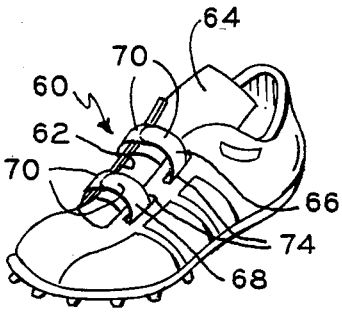
FIG. 3
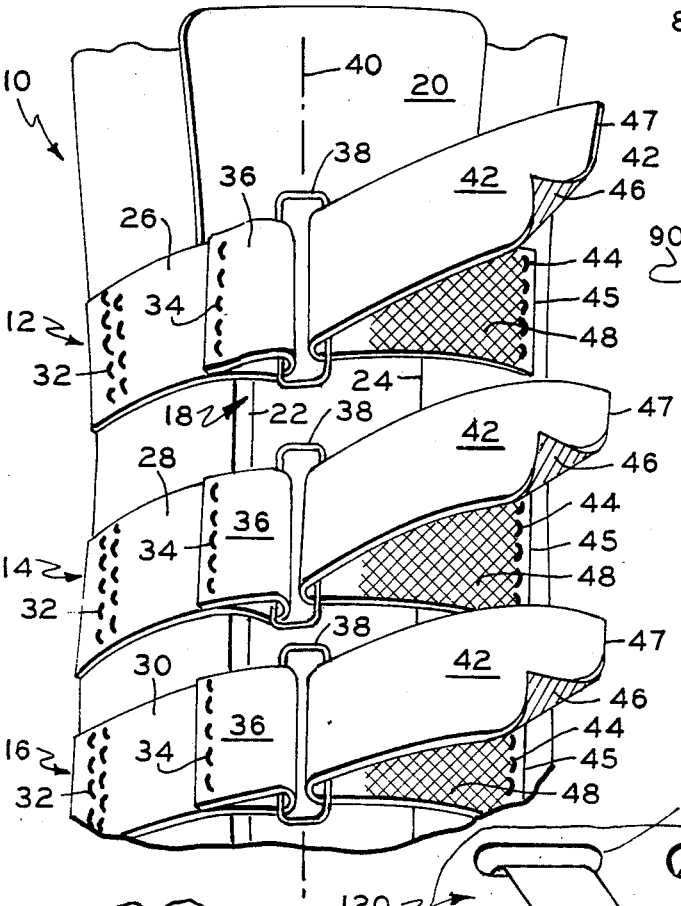
FIG. 4
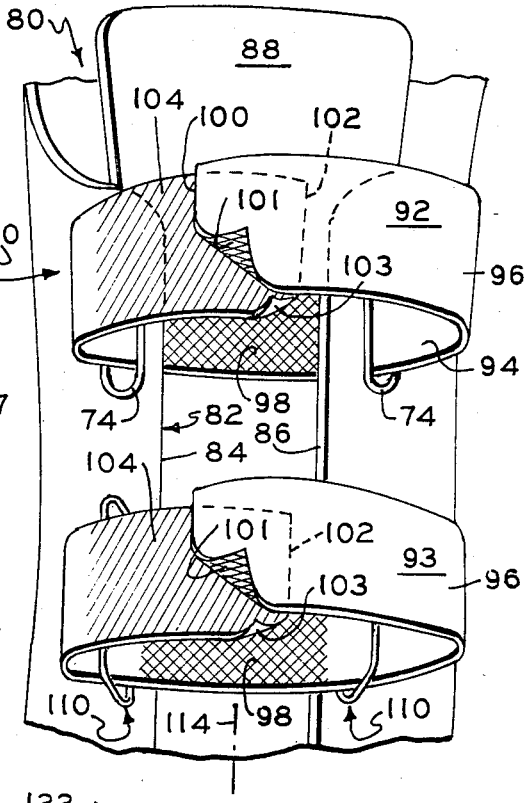
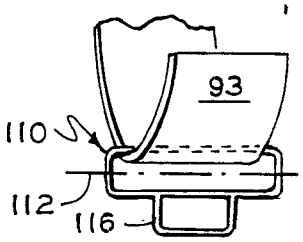
FIG. 5
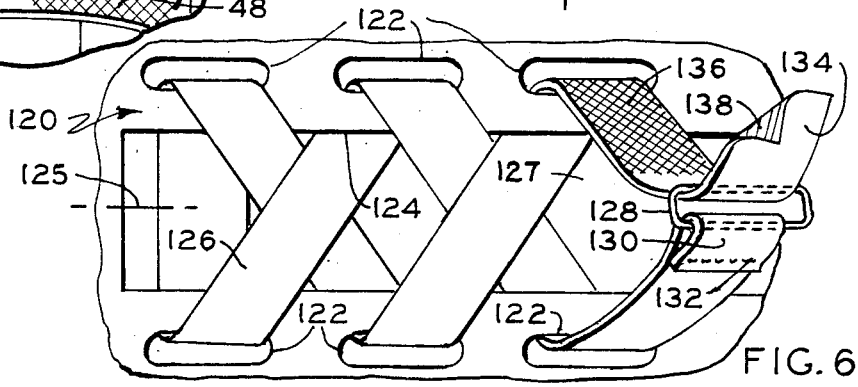
FIG. 6

SPORTS SHOE

FIELD OF THE INVENTION

The present invention relates to shoes and more particularly to sports shoes with a new type of fastener that eliminates conventional laces.

BACKGROUND OF THE INVENTION

A variety of different devices have been previously employed for fastening boots to secure them to the foot. The laces that are used normally take a good deal of time to tie and frequently the ends of the laces hang down where they can get in the way or be stepped on. Moreover, tying conventional shoelaces is difficult or impossible for certain handicapped individuals. Children also find laces difficult to tie. There are a number of other problems with laces that will be apparent. For example, they often tend to come undone. In other cases, they are too tight at the top where they are tied and fairly loose near the bottom of the shoe. Other disadvantages of shoelaces will be apparent. For example, they often become frayed and broken.

Sticky cloth of the type commonly sold under the trademark Velcro has come into common use in holding together various parts of clothing articles. This sticky cloth is composed of two component fabrics of different compositions adapted to stick together. One component normally comprising loops of fibers whereas the other comprising hooks of the proper size to stick in the loops. For convenience this cloth which sticks to itself will be referred to hereinafter as "sticky cloth". While sticky cloth has been used for a variety of purposes, there has been no satisfactory way of effectively using sticky cloth as a substitute for shoelaces. One problem with sticky cloth in some applications is it's tendency to pull apart or peel apart. Another problem is it's limited inherent strength. A third problem is the difficulty of bonding various layers together. This results from problems in placing the sticky fabric layers between interleaved layers of compatible cloth of different compositions adapted to stick together when pressure is applied. For example, when two layers of loops are relatively close together it may be difficult or impossible to quickly and easily insert a third layer having hooks on both surfaces between the two adjacent layers. Another problem is the need to have the sticky fabric material readily accessible but yet in a position and location where the ends will not dangle and tend to get caught on things that could loosen them while at the same time making provision for the stresses to be exerted in such a way that there is very little chance for the adhered layers of sticky cloth to come apart.

In view of these and other shortcomings of the prior art, the invention then comprises the features hereinafter distinctly described and particularly pointed out in the claims, these being indicative, however, of only a few of the various ways that the principles of the invention can be employed. The invention will now be described by way of example with reference to the figures wherein:

THE FIGURES

FIG. 1 is a perspective view of a sports shoe embodying the invention.

FIG. 2 is a perspective view of another shoe such as a baseball shoe embodying the invention.

FIG. 3 is a top view of the shoe in FIG. 1.

FIG. 4 is a view similar to FIG. 3 of another embodiment of the invention.

FIG. 5 is a perspective view of a portion of the strap and one of the eyelets used for securing the strap to the shoe and FIG. 6 is a top view of yet another embodiment of the invention.

SUMMARY OF THE INVENTION

An improved shoe design is described including a provision for fastening the shoe to the foot without the use of shoelaces. A pair of shoes such as an athletic shoe is provided with an extended opening of the usual construction at the top to facilitate entry of the foot. Beneath the extended opening is the tongue of the shoe which is also in its usual place. On either side of the opening are provided elongated eyelets. For example, three eyelets may be provided on the right side of the opening and three on the left, the latter being positioned in lateral alignment with those on the right so that three pairs of eyelets are provided. These pairs of lace receiving means or eyelets are distributed longitudinally along the length of the opening. For each pair of eyelets is provided at least one strap having one or both surfaces at least partially covered with a sticky cloth material composed of two component fabrics of different compositions adapted to stick together. For example, on one surface can be provided a multiplicity of fiber loops extending up from the surface while on the other can be provided a multiplicity of hooks adapted to stick in the loops when pressure is applied. The eyelets are characterized by having elongated openings wide enough to accommodate the strap. The strap, or if several are used, each strap passes through one of the eyelets on the opposite side of the shoe from the opening and one end of each strap is secured to the shoe either by being looped through an opening in the shoe or by being firmly secured at its end to the shoe. Typically, when more than one strap is used, one end thereof is attached securely to the shoe, for example, by sewing while the other end extends across the opening through the elongated eyelet, is folded back upon itself and its ends are bonded together. Thus, the strap extends in this situation from one side of the shoe where it is firmly secured across the opening through the eyelet and thence back to its beginning where its overlapping ends are pressed together and secured in place by the sticky fabric layers between them. This will hold the shoe tightly to the foot if the strap is pulled tight since the sticky fabric components together hold the strap under tension across the opening. The eyelets can be rings mounted within holes in the shoe so that the strap, in effect, passes through the eyelets and at the same time in the opening of the shoe within which each eyelet is mounted. Alternatively, the eyelets can comprise rings which extend upwardly from the surface of the shoe and include securing lugs at the lower end thereof to facilitate attachment of the rings to the surface of the shoe. If desired, the strap can comprise a single elongated strap having a center section that is passed back and forth across the opening through eyelets on either side of the opening and includes sticky cloth surfaces at one or both ends thereof. The invention can be applied to a variety of shoes or boots but is particularly well suited for use in baseball shoes, running and tennis shoes, golf, football shoes, and the like.

DETAILED DESCRIPTION

The invention will now be described by way of example with reference to the figures and particularly to FIG. 1. As seen in FIG. 1, a sports shoe 10 is provided having a plurality of straps 12, 14 and 16 that embody the invention and function as fasteners. The fasteners are shown in more detail in FIG. 3 and it will be seen that the fasteners 12–16 extend transversely across a longitudinally extending opening 18 of conventional construction and location within the shoe 10. Below the opening 18 is the usual tongue 20 also of conventional construction. The side edges of the elongated opening 18 are designated 22 and 24. The opening extends on the upper surface of the shoe from the portion adjacent to the ankle almost to the toe portion so that by spreading the opening apart one can easily place the foot in the shoe. This structure thus far described is conventional. Sewn to the right hand side of the shoe 10 are a plurality of longitudinally spaced apart centrally extending straps 26, 28 and 30 each held in place by a stitching 32. The ends of the straps 26–30 are sewn to themselves at 34 and within the loops 36 thus formed are held elongated eyelets 38 each being about four to six times wider than its height and each having its longitudinal axis aligned with the longitudinal axis 40 of the shoe. The structure 26–38 thus far describes and comprises one-half of each fastener 12–16, three of which are used in this case. The other half of each fastener comprises a second strap of fabric 42 sewn at 44 to the upper surface of the shoe opposite and in lateral alignment with the sections 26, 28 and 30 respectively by means of suitable stitching or, if desired, attached in any other suitable way, for example, adhesive, rivets or the like. In any event, the fixed end portion 45 at the left of the shoe is securely fastened to the shoe surface. At this point the strap extends toward the opening 18 and passes through one of the aligned eyelets 38 as clearly shown in the figure. One surface which can be referred to as the outside surface of the strap 42 is coated with a sticky cloth composed of two component fabrics 46 and 48 former of which can comprise tufts or loops of fibers the latter hooks adapted to stick in the loops. These sticky cloth surfaces 46 and 48 are aligned one above the other when the free end 47 of the strap is pulled tight. Then by applying downward pressure on the free end, the two sticky component fabrics 46 and 48 will become bonded together securely retaining the shoe on the foot by maintaining the strap under tension. It will be seen that this operation can be performed quickly with only one hand thereby saving time. Moreover, since the eyelet 38 applies pressure longitudinally of the strap there is little opportunity for the bonded sections of the strap to be pulled apart.

Refer now to FIG. 2 which illustrates another embodiment of the invention. In FIG. 2 is shown a baseball shoe 60 having the usually elongated opening 62 and tongue 64. Extending across the opening 62 are a pair of fasteners 66 and 68 each of which comprises a strap having ends 70 composed of adjacent contacting surfaces of sticky cloth that are bonded together during use to maintain the fasteners 66 and 68 tight across the opening 62. The straps 70 extend through eyelets 74 in the body of the shoe. Thus the eyelets 74 in this case comprise openings in the shoe itself.

Refer now to FIG. 4 which illustrates two different forms of fasteners in accordance with the invention in the same figure for simplicity of illustration. The top fastener 90 is the same as fasteners 70 of FIG. 2 and will illustrate their construction in more detail. Normally the two forms of straps shown in FIG. 4 will not be used together on the same shoe although this can be done if desired. Any of the eyelets can be composed of hard flexible rubber or plastic as well as from metal.

In FIG. 4 is shown the top of a shoe 80 having a central longitudinal opening 82 with aligned side edges 84 and 86 beneath which is the tongue 88 of the shoe. The top fastener designated 90 is the same as fasteners 70 already described in connection with FIG. 2. It consists of a single length of strap material 92 formed into a closed loop when in use having an inside surface 94 and outside surface 96. The strap 92 extends through eyelets 74 aligned on either side of the opening 82. The eyelets comprise metal rings mounted within openings in the material of the shoe itself so that the strap 92 extends through the rings and openings simultaneously. As shown in the figure, the central inner surface, i.e., upwardly facing surface in this case, is composed of a sticky fabric material 98. The ends of the strap 92 also have sticky fabric surfaces. At the end 100 is a sticky inside surface 101 facing downwardly, while end 102 has a sticky surface 104 facing upwardly and a sticky surface 103 facing downwardly. If the surface 98 at the center of the strap comprises fiber loops, then the downwardly facing surface 103 will comprise hooks. Similarly, if the downwardly facing surfaces 101, 103 both comprise loops, the upwardly facing surface 104 that is opposite loops adjacent to the free end 102 will comprise hooks. For simplicity of construction, the free end 102 is coated on both surfaces with the same sticky fabric comprising hooks while the centrally facing surfaces 98 and 101 comprise loops of fibers.

To use the fastener, one simply draws the ends tight and applies finger pressure to the upper free end 100 thereby securing all three layers together at the center in the space between the edges of the opening 82 of the shoe. The lower strap 93 is in all respects similar to the strap 92 with the same numerals referring to corresponding parts. The only difference in this case is that another form of eyelet is used. The eyelet in this case is designated with the numeral 110 and is also illustrated in FIG. 5. Each eyelet 110 is an elongated ring having a longitudinal axis 112 about four to eight times longer than its width and the longitudinal axis 112 is aligned with the longitudinal axis 114 of the shoe 80. The eyelets 110 each comprise a metal ring with a downwardly extending mounting or securing lug 116 at its lower end. The securing lug 116 is attached in any suitable manner, for example, by sewing, riveting, or by means of a loop of fabric to the upper surface of the shoe so that the eyelet portion 112 extends upwardly from the surface in position to receive a segment of the strap 93. A variety of methods of tacking or bonding the secured lug 116 to the surface of the shoe will be apparent to those skilled in the art. As best seen in FIG. 4, two eyelets 110 are secured in lateral alignment on opposite sides of the opening 82 so that the strap 93 will be able to pass through them both. During use, the tension applied to the strap 93 will cause the eyelets to swing toward one another thereby exerting tension on the securing lugs which in turn pull parts of the shoe on opposite sides of the opening toward one another when the shoe is on the foot.

Turn now to FIG. 6 which illustrates another embodiment of the invention. As shown in the figure, the upper portion of the shoe 120 is shown having three pairs of aligned eyelets 122 on opposite sides of a longitudinally extending opening 124 used to facilitate entry of the foot into the shoe and a tongue 127 of conventional construction. Extending through the openings 122 which are each elongated and aligned with the longitudinal axis 125 of the shoe is a single strap 126, the center portion of which is secured through the eyelets 122 closest to the toe of the shoe. From there, the strap is laced through each successive pair of openings or eyelets 122 proceeding toward the top of the shoe in a criss-cross manner similar to that used in conventional laces. However, in this case, one free end of the strap 126 is provided with a terminal eyelet 128 permanently secured through a loop 130 formed by sewing the end of the strap 126 to itself at 132. The opposite end 134 of the strap 126 is provided with a sticky cloth composed of two components of different compositions distributed longitudinally from one another near the free end 134, both components on the same surface. These sticky fabric components are designated 136 and 138. For example, section 136 can comprise fiber loops while 138 will then comprise fiber hooks. By pulling tightly on the free end 134 after extending it though the ring 128, one is able to tighten the strap to the desired degree. Then by pressing the sticky fiber material 138 against the upwardly extending loops 136 one is able to exert tension on the strap sufficient to securely hold the shoe tightly on the foot. A number of variations can be employed in the invention. For example, if the invention is applied to a golf shoe, three of the fasteners of the type 12, 14, and 16 are preferably used. The fasteners are distributed longitudinally on the top of the shoe and extend transversely across the top. The straps comprise two portions in each case sewn on opposite sides of the shoe, all as shown in FIG. 3. The eyelets can be metal or plastic or, if desired, flexible rubber. While a variety of sticky fabrics can be employed, one of the best suitable fabrics is sold under the trademark Velcro.

If the invention is applied for use on a tennis, golf, track or football shoe, or if it is used on a running or baseball shoe, it is usually desirable to use two longitudinally spaced apart laterally extending straps arranged and shown in FIGS. 2 and 4. As already described, the eyelets which can be formed from metal, plastic or flexible rubber are held in place within a permanent loop sewn on the end of the strap which is bonded or otherwise fixed to the surface of the shoe, for example, by being sewn in place. A piece of strap material that extends through the eyelet on the other side is coated with the Velcro fabric in the manner already described in connection with FIGS. 1 and 3.

It will be seen that the invention is highly effective in providing a secure means of holding the shoe on the foot. Since the tension exerted on the eyelets, 38 for example, is along the axis of the plane between the bonded layers 46 and 48 the tension will have little likelihood of unpeeling the bonded surfaces. Moreover since the eyelets 38, 74, or 122 as the case may be, are much longer than they are wide, the strap material extending through them will have little tendency to become worn and at the same time will be held reliably in place, remaining parallel to the upper contour of the shoe. The eyelets 74 have the advantage of being mountable within openings of the shoe itself. Therefore they require no separate means of attachment. The embodiment of FIG. 6 has the advantage of requiring only a single strap. All embodiments can be tightened and released within the use of only one hand.

Many variations in the invention will be apparent to those skilled in the art within the scope of the appended claims once the principles of the invention are understood.

I claim:

1. A shoe having an opening to facilitate entry of the foot, lace receiving means on opposite sides of the opening, said lace receiving means comprising at least one pair of eyelets, each eyelet of each such pair being located opposite the other on opposite sides of the opening for the foot, at least one single length of strap material, each length passing through one pair of eyelets and folded so as to be closed in a loop upon itself when in use and being removable from the shoe and replaceable in the nature of a shoelace, said strap having end portions with opposite surfaces of said end portions being placed in overlapping mating relationship and defining mating surfaces on each end of the strap composed of cloth areas of different compositions on opposite surfaces comprising hooks on one mating cloth surface and loops on the other mating cloth surface adapted to stick together when placed in contact with each other, the opposite ends of said strap being thereby secured to each other to hold the shoe tightly on the foot whereby the opening in the shoe is held together solely by the bond between the ends of the strap and each said strap being otherwise unconnected to the shoe whereby it can be withdrawn from the eyelets when the ends thereof are freed from one another.

2. The article of claim 1 wherein a center section of said strap is covered with a cloth area of a first composition, a portion of one end of the strap is coated with a cloth surface of different composition and one of said compositions comprises loops, the other of said composition comprises hooks, whereby the strap is bonded together by two separate sets of bonds wherein one end of said strap is sandwiched between an opposite end and said center section.

* * * * *